US006050905A

United States Patent [19]

Tate

[11] Patent Number: 6,050,905

[45] Date of Patent: Apr. 18, 2000

[54] DIVOT TOOL WITH BALL MARKER

[76] Inventor: John R. Tate, 11621 Markon Dr., Garden Grove, Calif. 92841

[21] Appl. No.: 09/187,685

[22] Filed: Nov. 5, 1998

[51] Int. Cl.[7] ..... A63B 57/00

[52] U.S. Cl. ..... 473/408

[58] Field of Search ..... 473/408, 286; D21/793

[56] References Cited

U.S. PATENT DOCUMENTS

| | | | |
|---|---|---|---|
| D. 327,910 | 7/1992 | Cantlon | D21/793 |
| 3,415,518 | 12/1968 | Root | 473/408 |
| 4,151,937 | 5/1979 | Jarosh et al. | 473/408 |
| 4,627,621 | 12/1986 | Tate | 473/408 |
| 5,295,683 | 3/1994 | Tate | 473/408 |
| 5,305,999 | 4/1994 | Tate | 473/408 |
| 5,388,824 | 2/1995 | Reimers | 473/408 |

*Primary Examiner*—Steven Wong

*Attorney, Agent, or Firm*—Charles H. Thomas

[57] ABSTRACT

A golf surface repair tool is formed with a pair of mutually engageable component elements that may be releasably attached together. The component elements form a body from which a pair of narrow, elongated legs extend in generally coplanar alignment to define a gap therebetween. One of the body components is hollowed out to form an enclosure therewithin. The other body component is provided with a marking pen mounted thereon. When the two components of the tool are separated, the tip of the marking pen is exposed for use in applying identifying indicia to a golf ball. The two separable components of the golf surface repair tool can, alternatively, be releasably secured to each other so that the marking pen projects into the enclosure to isolate it from accidental contract with the golfer's skin or clothing. A thumb grip depression facilitates separation of the two separable components. If desired, the tool may be equipped with a pencil lead for writing a golf score on a score card and with a golf shoe spike cleaner. A golf club handle rest is preferably formed on the tool remote from the legs and facing concave outwardly therefrom.

12 Claims, 9 Drawing Sheets

DIVOT TOOL WITH BALL MARKER

BACKGROUND OF THE INVENTION

1. Field of the Invention

The present invention relates to a golf accessory useful as a golf playing surface repair tool and which houses a marking pen for placing identifying marks on golf balls.

2. Description of the Prior Art

Divot or golf surface repair tools have been available for use by golfers for many years. Conventional divot tools are often formed of metal and are configured to include a body portion from which a pair of elongated legs extend in a generally mutually parallel arrangement. A golfer utilizes such a divot repair tool by inserting the legs into a golf surface, either a fairway or a green, in order to spruce up the surface following a shot in the game of golf.

Throughout the years golf divot tools have been devised which incorporate other features or accessories which are useful to golfers. For example, U.S. Pat. No. 4,627,621 discloses a golf accessory tool which serves both as a divot tool and as a money clip. U.S. Pat. Nos. 5,294,683 and 5,305,999 depict and describe golf divot tools which provide seating recesses to receive golf ball markers. Such markers are typically fabricated as small, disc-shaped structures, sometimes bearing a surface ornamentation, that are placed upon the field of play to mark the position of a golf ball until the golfer's next shot. Other divot repair tools provide cradles that are located remote from the divot tool legs so as to support the handle of a golf club, thereby holding the handle of the club off of the grass playing surface. Still other divot tools are configured to form golf cleat or spike cleaners and other implements useful in the game of golf.

SUMMARY OF THE INVENTION

Prior to the present invention, however, it has not occurred to anyone that a golf ball marking pen could be incorporated into the structure of a golf surface repair tool. Golfers frequently use marking pens to place small, identifying indicia on their golf balls so that the golf balls of different players can be positively distinguished from each other when on the field of play. However, until the present invention it has been necessary for a golfer to remember to carry a marking pen, such as a brightly colored felt-tip marker, in the golf bag or in the golfer's pocket. Quite often the caps for such marking pens can become dislodged or misplaced. When this occurs the tip of the marking pen is exposed continuously, thus leading to untended stains on the golfer's hands, clothing, and golf bag. Also, a golfer is often apt to forget to bring a conventional marking pen onto the field of play for purpose of placing identifying indicia on the golf balls to be used during a game of golf. The golfer is then forced to borrow a marking pen from some other player in the group, provided that at least one player in the group has remembered to bring a marking pen.

The present invention provides a convenient and unique way for equipping a golfer with a ball marking pen in such a manner that the golfer is not likely to forget or misplace the ball marking pen and in a manner in which the clothing and skin of the golfer are unlikely to be exposed to accidental contact with the tip of the ball marking pen.

According to the present invention a ball marking pen, such as a felt-tip pen, is combined with the structure of a golf surface repair tool in such a manner that the tip of the marking pen is enclosed within the structure of the golf surface repair tool so as to prevent accidental contact of the pen tip with the clothing or skin of the user. Nevertheless, the marking pen is readily available for use in placing identifying indicia on a golf ball when the occasion arises. Moreover, the structure of the device of the invention is configured as, and is always available for use as, a golf surface repair tool.

In one broad aspect the present invention may be considered to be a golf surface repair tool formed of a pair of detachable and releasably engageable body components. A first of the body components has a pair of narrow, elongated legs extending therefrom. The pair of legs define a gap therebetween. The body components together define an enclosure therebetween when releasably engaged. A marking pen is mounted on one of the body components so that the marking pen is housed within the enclosure when the body components are releasably engaged with each other. On the other hand, the marking pen is exposed for use when the body components are separated from each other.

Additional features may also be incorporated into the device of the invention. For example, one of the body components may be configured with a concave club rest having opposing ends. The club rest resides remote from the legs when the body components are releasably engaged together. In addition, a pencil lead may be embedded in one of the body components at one of the ends of the concave club rest. The pencil led is preferably a hard lead that isn't likely to break off. The golfer is thereby provided with a pencil in a holder having the shape and function of a golf surface repair tool. Golfer's typically use pencils to write their golf score for each hole on a score card, and to initial the score cards of other golfers.

In a variation of the foregoing embodiment the same body component bearing the pencil led may also be configured to form a pointed cleat cleaner at the end of the club rest opposite the pencil lead. Together the pencil lead and cleat cleaner form upright demarcations at the ends of the club rest so that a club is unlikely to slide laterally off of the rest. The cleat cleaner preferably narrows to a point that may be inserted into spaces between the golf cleats or spikes to dislodge dirt, matted grass clippings, and other debris therefrom.

The body components of the golf surface repair tool of the invention may be configured to define a shallow, thumb-receiving depression. This depression provides a seat for the ball of the thumb of a golfer to facilitate manipulation of the tool for sprucing up a golf surface, cleaning the cleats of a golf shoe, or writing a golf score on a score card. The thumb grip depression provides a convenient and comfortable grip with which to hold the golf surface repair tool of the invention. It may also be configured in such a manner as to facilitate separation of the tool body components.

In another broad aspect the invention may be considered to be golf surface repair tool comprising a first body member; a pair of thin, longitudinal legs extending in substantially mutually coplanar relationship from the first body member and defining a gap therebetween; a second body member releasably engaged with the first body member, whereby the body members define an enclosure therebetween when engaged with each other; and a marking pen mounted upon one of the body members and projecting into the enclosure and toward the other of the body members when the body members are releasably engaged with each other. The making pen is exposed when the body members are disengaged from each other.

In still another broad aspect the invention may be considered to be an improvement in a golf surface repair tool having a body and a pair of narrow, elongated legs extending from the body and oriented in substantially mutually coplanar relationship and defining a gap therebetween. The improvement of the invention resides in the fact that the body is formed of a pair of component elements that are releasably engageable to define an enclosure therewithin. These component elements are also separable from each other. A marking pen is mounted on one of the component elements so as to fit into the enclosure when the component elements are releasably engaged together. Furthermore, the marking pen is exposed for use when the component elements are separated from each other.

The invention may be described with greater clarity and particularity by reference to the accompanying drawings.

DESCRIPTION OF THE EMBODIMENT

Figure 3:
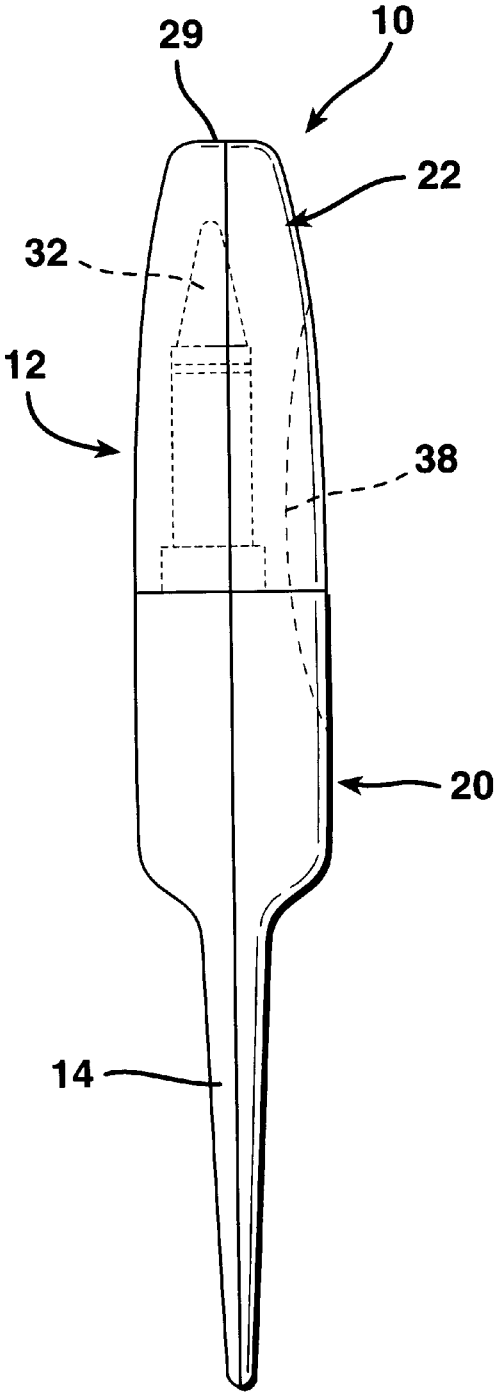
FIG. 3 is a left-side elevational view of the golf surface repair tool of FIG. 1.
Figure 4:
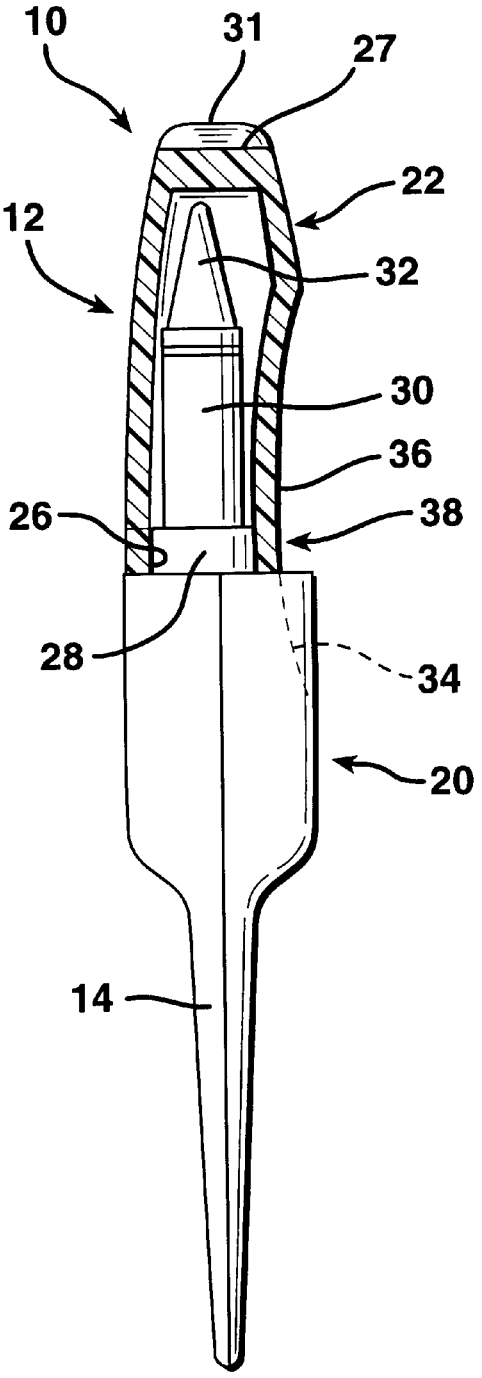
FIG. 4 is an elevational view, partially in section, taken along the lines 4—4 of FIG. 2.

FIGS. 1–6 of the drawings illustrate a golf surface repair tool indicated generally at 10 of the type utilized to repair fairway divots and spruce up golf greens. The golf surface repair tool 10 is about 2.75 inches long, about 1.125 inches wide, and about 0.45 inches in thickness. The repair tool 10 is formed with a body 12 from which a pair of narrow, elongated legs 14 and 16 extend. As best illustrated in FIGS. 3 and 4, the legs 14 and 16 are oriented in substantially mutually coplanar relationship and, as illustrated in FIGS. 1, 2, 5, and 6, together define a gap 18 therebetween. The gap 18 is typically on the order of from between about one-quarter and one-half of an inch in width.

Figure 5:
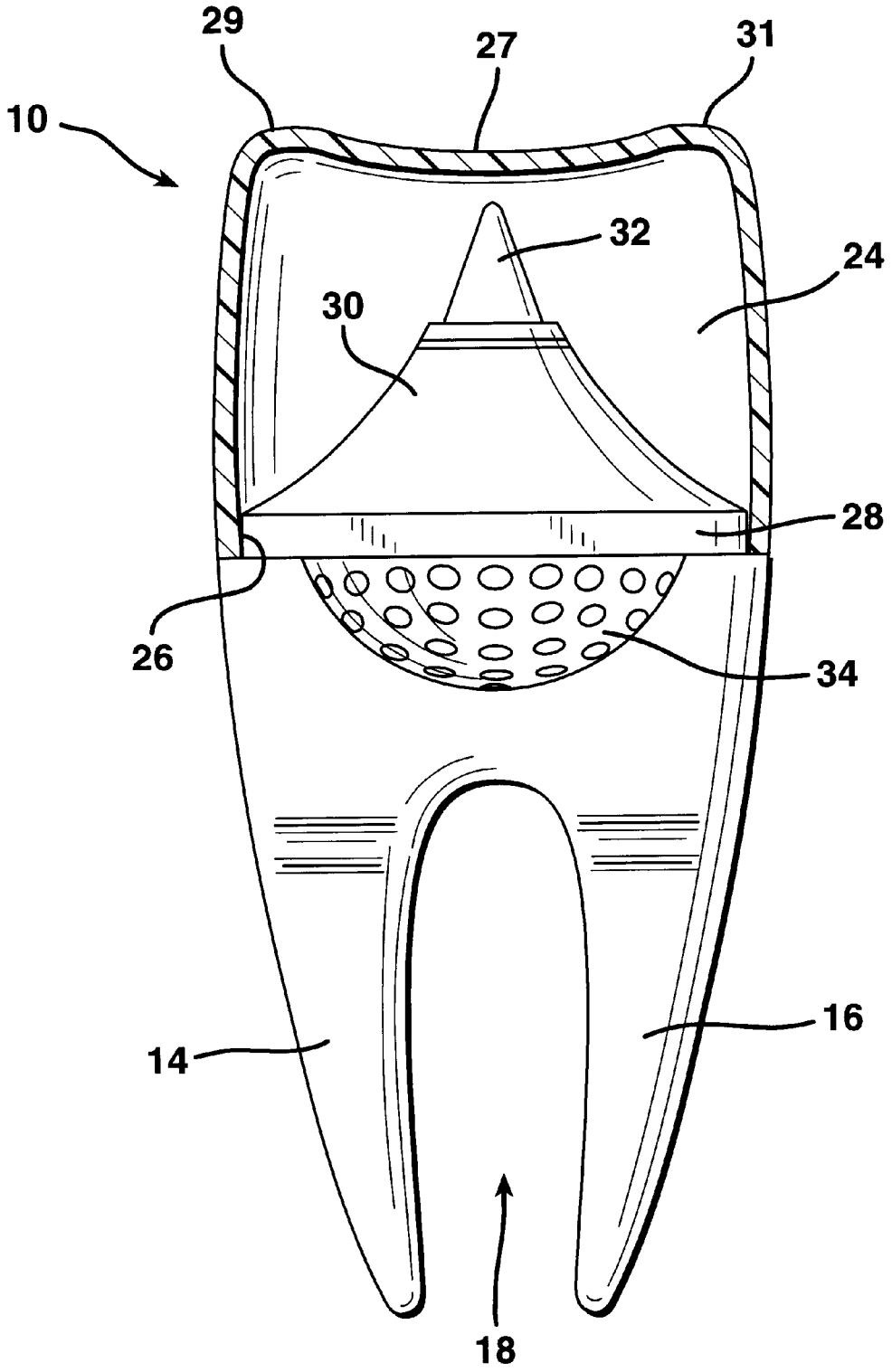
FIG. 5 is a front elevational view, shown partially in section to illustrate the manner in which the marking pen in the golf surface repair tool of FIG. 1 is encapsulated when the body components of the tool are releasably engaged with each other.

The golf surface repair tool 10 is formed of a pair of detachable and releasably engageable body components 20 and 22. Both of the body components 20 and 22 are preferably formed as molded plastic structures. The narrow, elongated legs 14 and 16 extend from the first body component 20. The second body component 22 is largely a hollow structure. The body components 20 and 22 together define an enclosure 24 therebetween when releasably engaged together as depicted in FIG. 5. More specifically, the body component 22 has an open mouth 26 that fits about an upstanding marking pen holder base 28 that projects outwardly from the body portion 20 in a direction opposite the legs 14 and 16. The mouth 26 of the body portion 22 exerts a snug, friction fit around the base 28 of the marking pen holder 30. The body portion 24 tapers upwardly and inwardly from the boss 28 to form an inclined marking pen holder region 30. The marking pen holder region 30 forms a casing for a conventional soft-tip marking pen 32, the tip of which protrudes outwardly from the marking pen holder 30.

The marking pen 32 is thereby mounted on the body component 20 so as to fit into the enclosure 24 when the body component elements 20 and 22 are releasably engaged together, as illustrated in FIGS. 1–5. In this condition, the marking pen 32 is isolated from accidental contact with the skin or clothing of the golfer by means of the body component 22, which serves as a cap.

Figure 6:
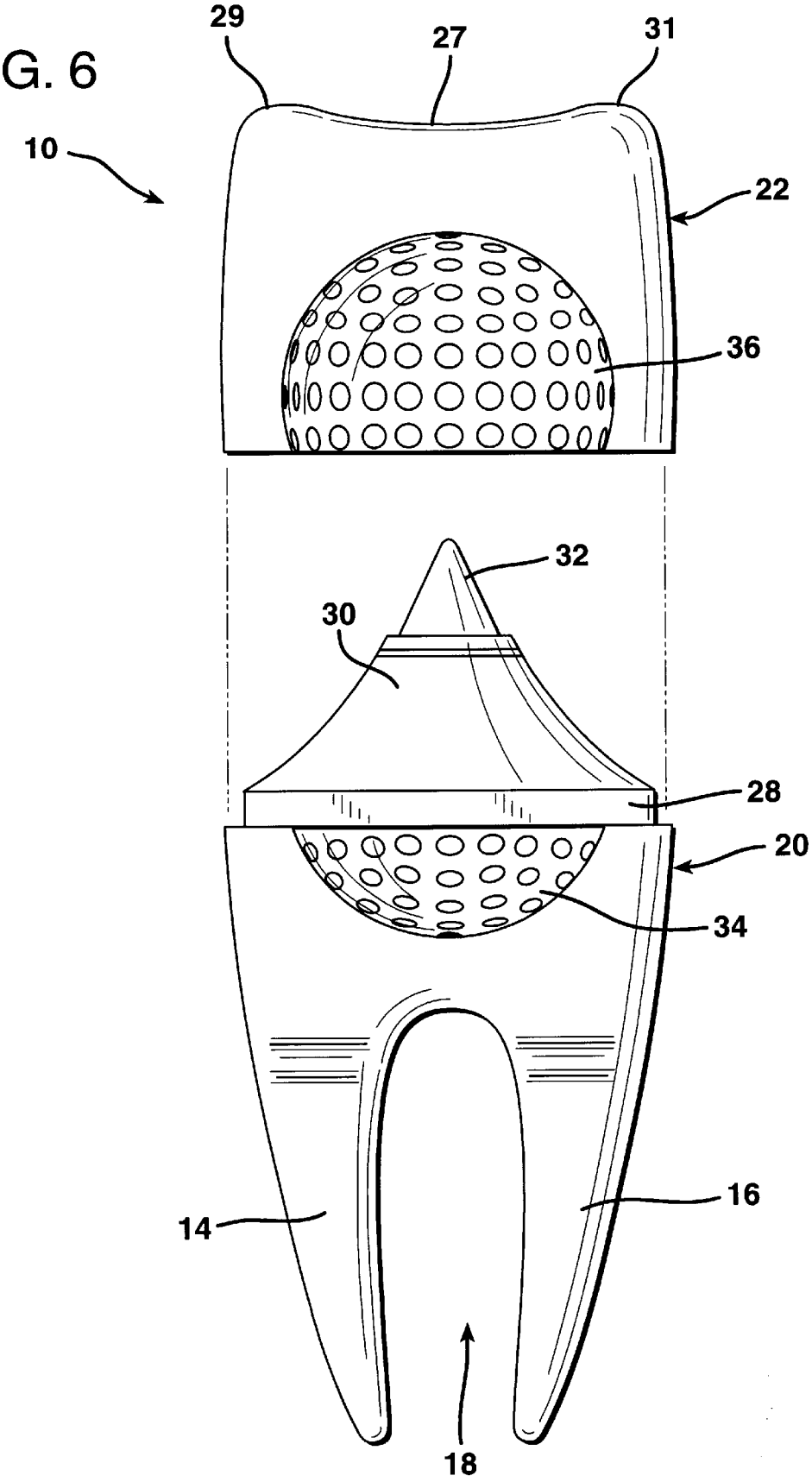
FIG. 6 is a front elevational view of the golf surface repair tool of FIG. 1 shown with the body components detached from each other.
Figure 7:
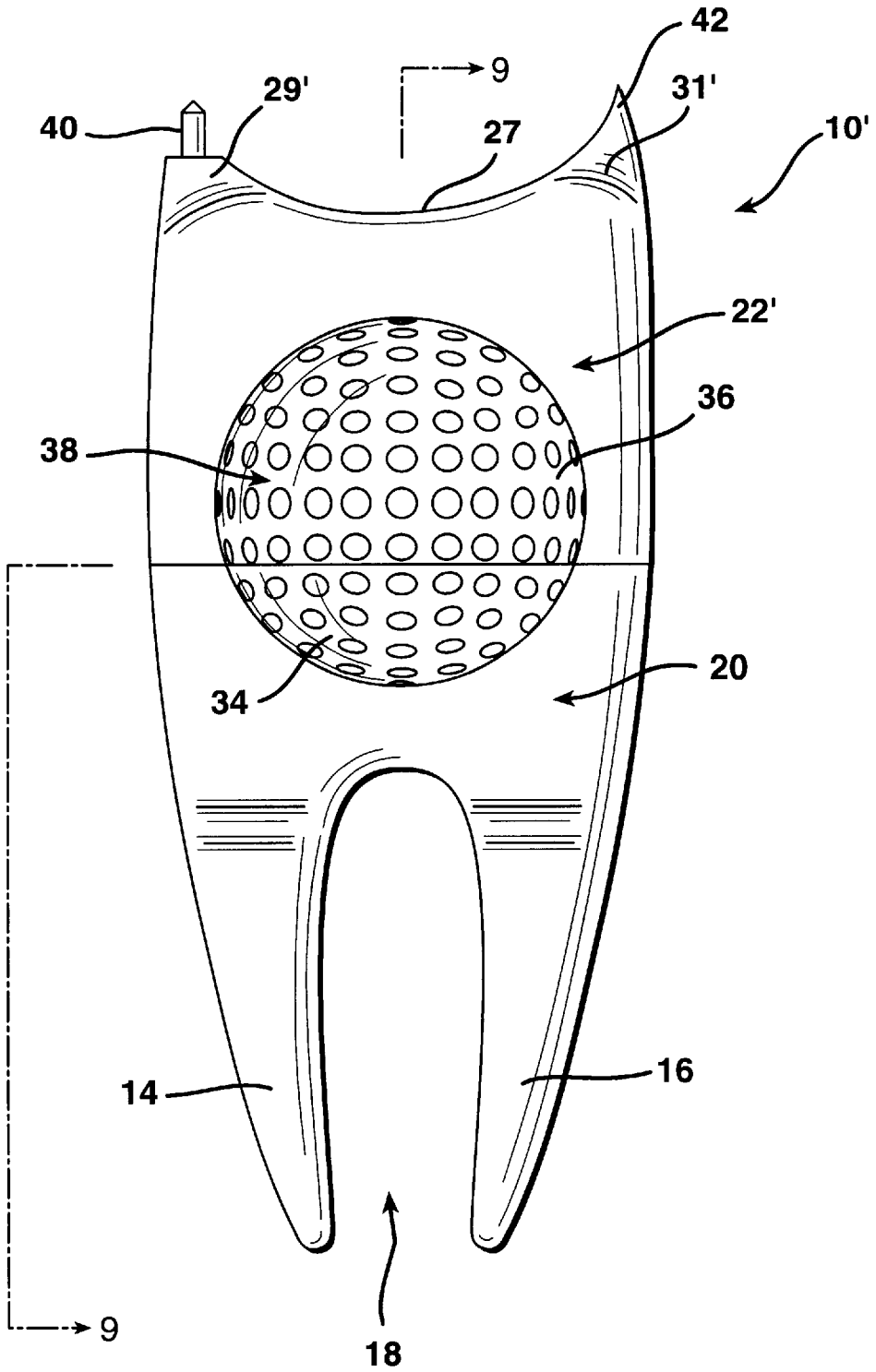
FIG. 7 is a front elevational view of an alternative embodiment of the golf surface repair tool of the invention.
Figure 8:
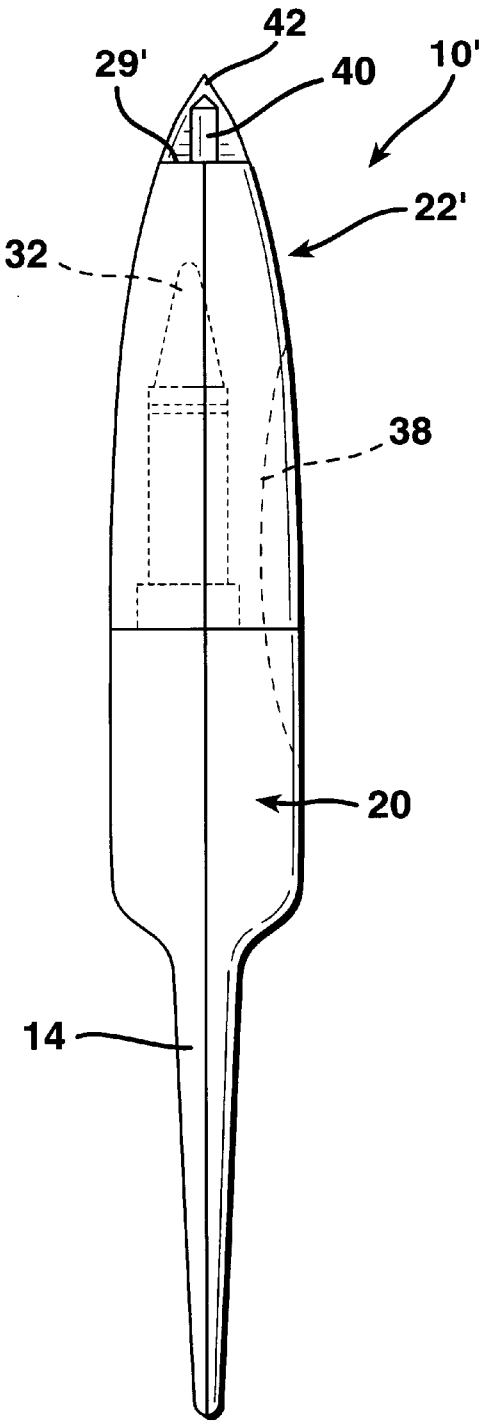
FIG. 8 is a right-side elevational view of the tool of FIG. 7.
Figure 9:
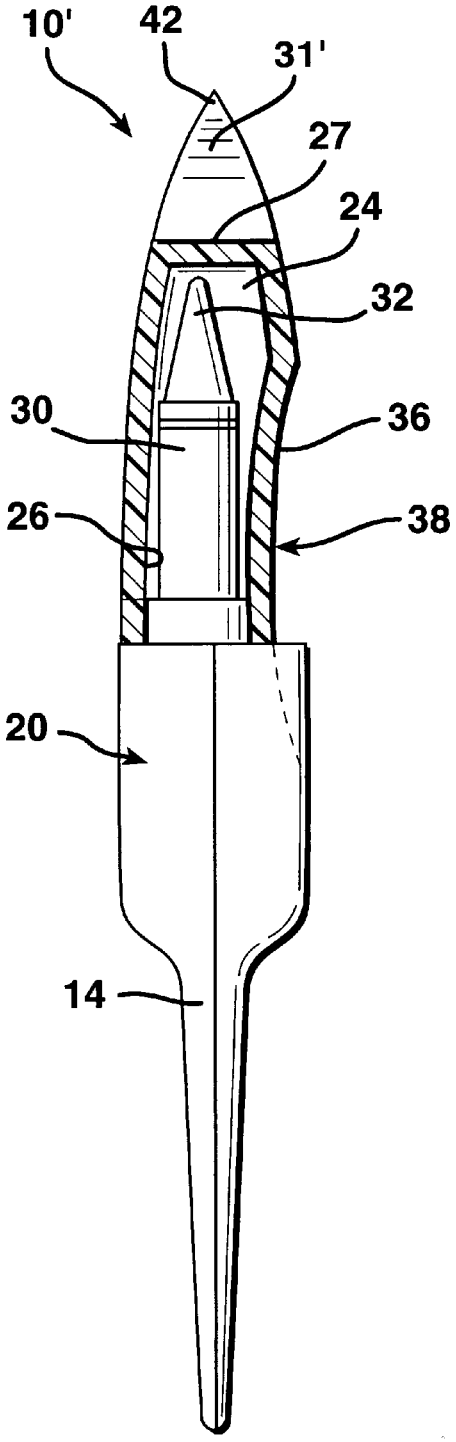
FIG. 9 is an elevational view, partially in section, taken along the lines 9—9 of FIG. 7.
Figure 10:
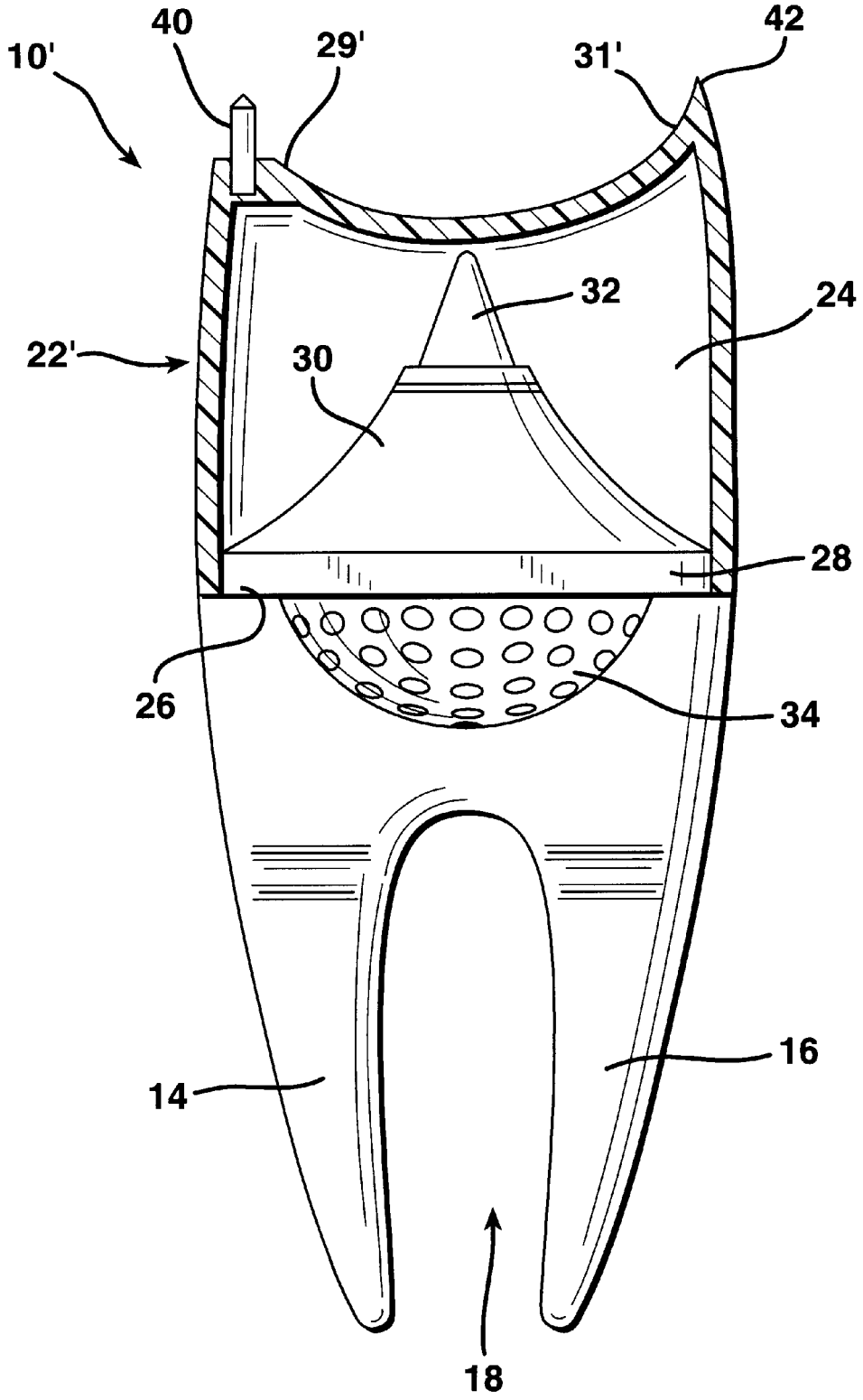
FIG. 10 is a front elevational view of the embodiment of the tool of FIG. 7, shown partly in section and showing the component elements thereof releasably secured together.
Figure 11:
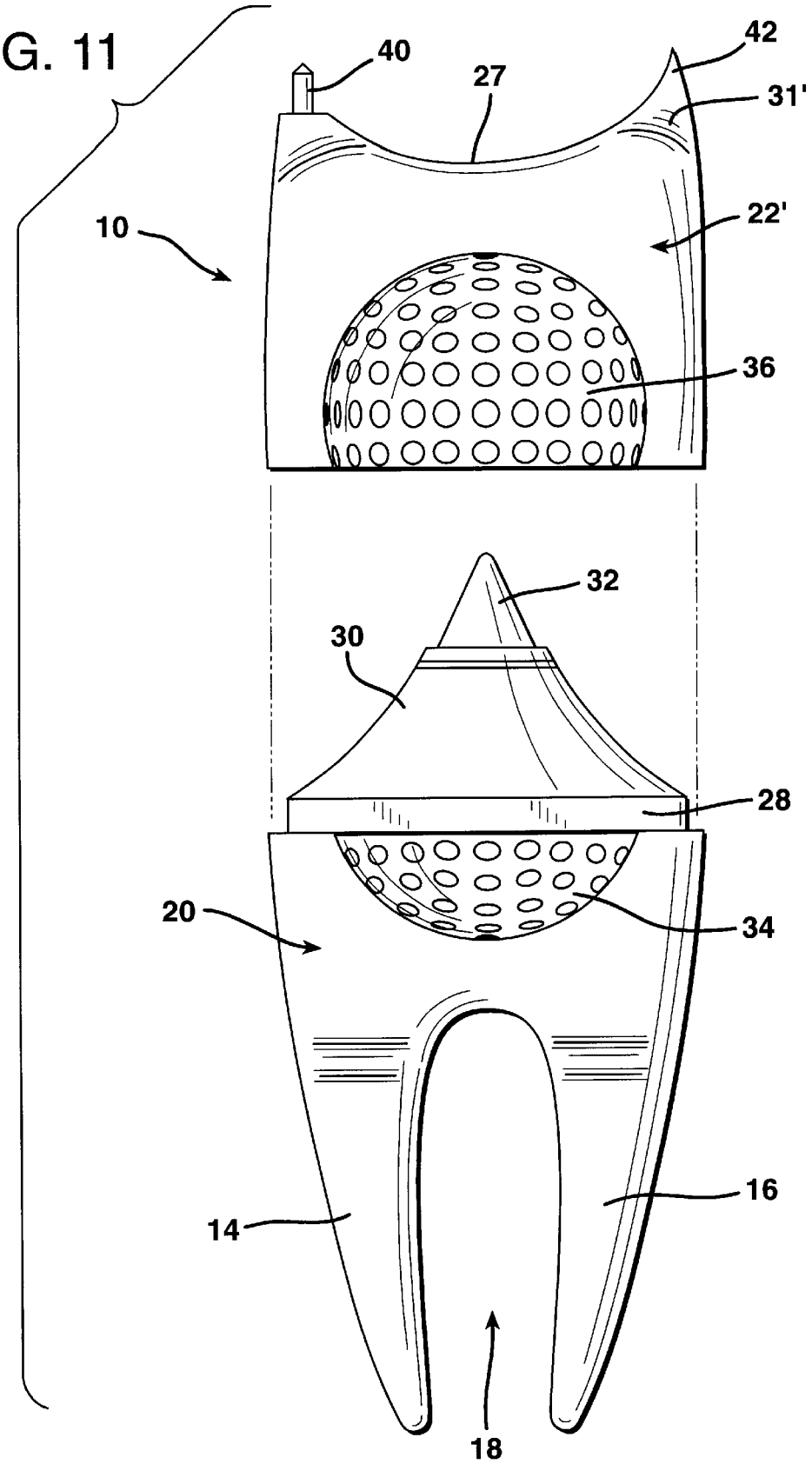
FIG. 11 is a front elevational view showing the separable components of the tool of FIG. 10 detached from each other.

As shown in FIG. 6, the body component elements 20 and 22 may be separated from each other by pressing or pulling the shell-like body component 22 away from the body component 20. Once the component 22 is detached from the component 20, the tip of the marking pen 32 is exposed for use.

Figure 1:
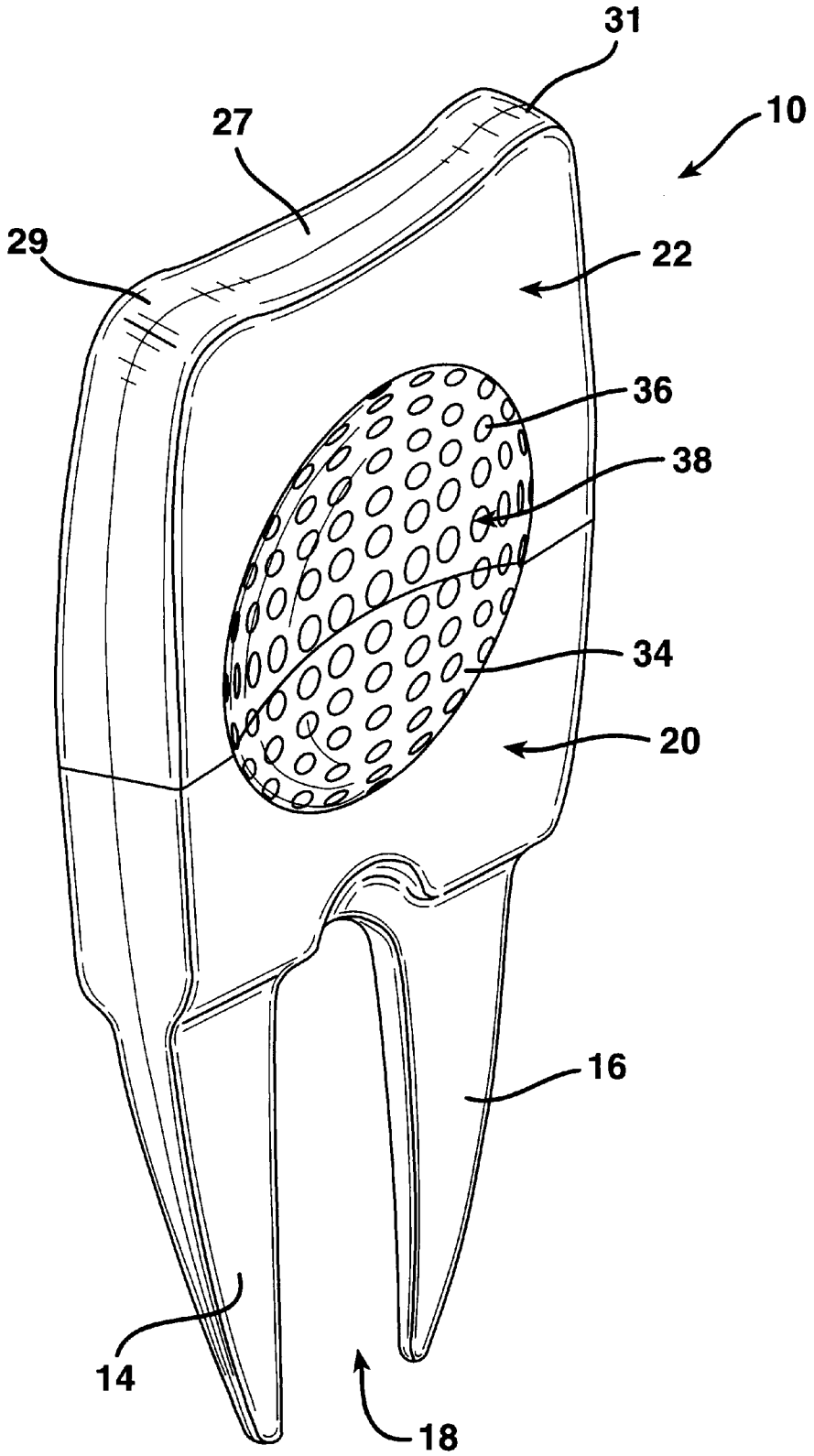
FIG. 1 is a perspective view of one preferred embodiment of a golf surface repair tool according to the invention.
Figure 2:
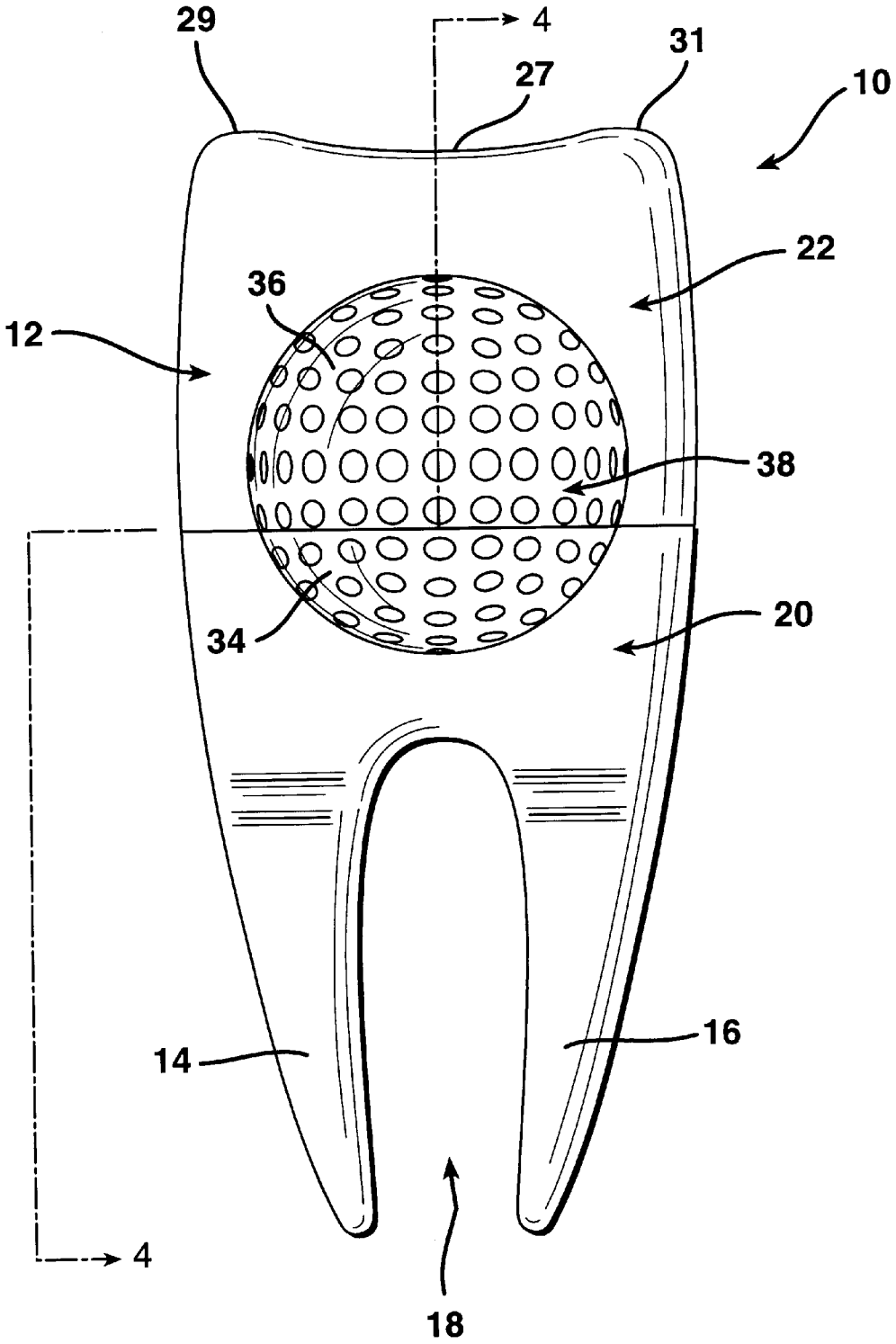
FIG. 2 is a front elevational view of the golf surface repair tool of FIG. 1.

Preferably, the body components 20 and 22 are formed with concave surfaces 34 and 36, respectively, that meet at the interface between the body component elements 20 and 22. When the body components 20 and 22 are releasably secured together, as depicted in FIG. 1, the concave surfaces 34 and 36 together define a shallow, thumb receiving depression 38, which is evident in FIG. 4. The depression 38 is particularly adapted to provide a thumb grip into which the ball of the thumb of a golfer's hand fits.

The depression 38 facilitates the separation of the body components 20 and 22 when separation is desired in order to use the marking pen 32. To separate these components the golfer grips the legs 14 and 16 with the fingers of one hand while placing the thumb of the same hand in the depression 38 pointed in a direction opposite the legs 14 and 16. The golfer then presses with the thumb outwardly away from the legs 14 and 16 against the concave surface 36 of the body component 22 to separate the components 20 and 22 as illustrated in FIG. 6. The depression 38 may have an ornamental surface texture configured to resemble the dimples on a golf ball as illustrated in the drawings.

When the component body elements 20 and 22 are separated as illustrated in FIG. 6, the golfer may grip the legs 14 and 16 to use the body portion 20 as a writing implement. The golfer utilizes the marking pen 32 to place identifying indicia on a golf ball. Once the ball has been marked, however, the component elements 20 and 22 are reassembled, as illustrated in FIGS. 1–5 so as to isolate the making pen 32 within the enclosure 24.

Opposite the mouth 26 the second body element 22 is configured with a concave club rest 27 having opposing ends 29 and 31. The club rest 27 is concave outward in a direction opposite the legs 14 and 16 and resides remote from the leg 14 and 16 when the body components 20 and 22 are releasably engaged together. The tool 10 may thereby be utilized as a golf club handle support to hold a golf club handle off of wet grass. This is done by forcing the legs 14 and 16 a short distance into the turf so that the tool 10 stands upright as depicted in the drawings. The golf club handle at the end of the shaft may then rest atop the cradle formed by the concave club rest 27 to hold the club handle off of the ground, while the head of the club rests on the turf.

Further variations and modifications of the combination ball marker and divot tool are also possible. Once such modification is illustrated in FIGS. 7 through 11. As shown in those drawing figures, the golf surface repair tool 10' has a first body component 20 with legs 16 and 18 extending therefrom and a golf ball marking pen 32 mounted thereon as in the golf surface repair tool 10. The second body component 22' of the embodiment of FIGS. 7–11 differs somewhat from the body component 22 of the embodiment of FIGS. 1–6. Specifically, the body component 22' includes at the end 29' of the concave club rest 26 a flattened region into which a hard pencil lead 40 is embedded. The pencil lead 40 is permanently mounted in the body component 22' remote from the legs 14 and 16 and has a point that protrudes from the body component 22' in a direction opposite the legs 14 and 16 when the body members 20 and 22' are releasably engaged with each other.

At the opposite end 31' of the club rest 27, the second body member 22' is configured to form a pointed cleat cleaner 42. The cleat cleaner 42 is sharp enough to dislodge mud, dirt, and matted grass clippings from the cleats or spikes of a conventional golf shoe. The cleat cleaner 42 extends from the body component 22' in a direction parallel to the pencil lead 40. The pointed cleat cleaner 42 also is formed in the body component 22' so as to protrude externally therefrom remote from the legs 14 and 16.

Undoubtedly, numerous variations and modifications of the invention will become readily apparent to those familiar with golf surface repair tools. For example, the tool could be reconfigured so that the marking pen 32 is mounted on the second body portion 22 or 22' so as to extend into an enclosure or cavity defined in the first body portion 20. Also, the body components 20 and 22 or 22' can be provided with cooperative detents rather than just relying upon a friction fit to hold them together. The scope of the invention should therefore not be construed as limited to the specific to embodiments depicted and described.

I claim:

1. A golf surface repair tool formed of detachable and releaseably engageable body components, wherein a first of said body components has a pair of narrow, elongated legs extending therefrom that define a gap therebetween, a second of said body components is configured with a concave club rest having opposing ends and which resides remote from said legs when said body components are releaseably engaged together, and said body components together define an enclosure therebetween when releaseably engaged, and further comprising a marking pen mounted on one of said body components so that said marking pen is housed within said enclosure when said body components are releaseably engaged with each other and exposed for use when said body components are separated from each other.

2. A golf surface repair tool formed of detachable and releaseably engageable body components, wherein a first of said body components has a pair of narrow, elongated legs extending therefrom that define a gap therebetween, another of said body components has a pencil lead embedded therein and said body components together define an enclosure therebetween when releaseably engaged, and further comprising a marking pen mounted on one of said body components so that said marking pen is housed within said enclosure when said body components are releaseably engaged with each other and exposed for use when said body components are separated from each other.

3. A golf surface repair tool according to claim 2 wherein said another of said body components forms a cleat cleaner.

4. A golf surface repair tool formed of detachable and releaseably engageable body components, wherein a first of said body components has a pair of narrow, elongated legs extending therefrom that define a gap therebetween, and said body components together define an enclosure therebetween when releaseably engaged, and further comprising a marking pen mounted on one of said body components so that said marking pen is housed within said enclosure when said body components are releaseably engaged with each other and exposed for use when said body components are separated from each other, and further comprising concave surfaces on said body components that together define a shallow thumb-receiving depression.

5. A golf surface repair tool formed of detachable and releaseably engageable body components, wherein a first of said body components has a pair of narrow, elongated legs extending therefrom that define a gap therebetween, and said body components together define an enclosure therebetween when releaseably engaged, and further comprising a marking pen mounted on one of said body components so that said marking pen is housed within said enclosure when said body components are releaseably engaged with each other and exposed for use when said body components are separated from each other, and wherein said marking pen is mounted on said first of said body components.

6. A golf surface repair tool comprising a plurality of body members including: a first body member; a pair of thin, longitudinal legs extending in substantially mutually coplanar relationship from said first body member and defining a gap therebetween; a second body member releaseably engaged with said first body member, wherein said body members define an enclosure therebetween when engaged with each other; and a marking pen mounted upon one of said body members and projecting into said enclosure and toward another of said body members when said body members are releaseably engaged with each other, and wherein said marking pen is exposed when said body members are disengaged from each other, and a pencil lead embedded in said another body member and protruding therefrom in a direction opposite said legs when said body members are releaseably engaged.

7. A golf surface repair tool according to claim 6, wherein said another body member is configured to conform a cleat cleaner that extends therefrom in a direction parallel to said pencil lead.

8. A golf surface repair tool comprising a plurality of body members including: a first body member; a pair of thin, longitudinal legs extending in substantially mutually coplanar relationship from said first body member and defining a gap therebetween; a second body member releaseably engaged with said first body member, wherein said body members define an enclosure therebetween when engaged with each other; and a marking pen mounted upon one of said body members and projecting into said enclosure and toward another of said body members when said body members are releaseably engaged with each other, and wherein said marking pen is exposed when said body members are disengaged from each other, and wherein concave surfaces are formed into said body members, and said concave surfaces meet when said body members are releaseably engaged with each other to define a thumb grip depression to receive the thumb of a golfer.

9. In a golf surface repair tool having a body and a pair of narrow elongated legs extending from said body and oriented in substantially mutually coplanar relationship and defining a gap therebetween, the improvement wherein said body is formed of component elements which are releaseably engageable to define an enclosure therewithin and which are also separable from each other, and further comprising a marking pen mounted on one of said component elements so as to fit into said enclosure when said component elements are releaseably engaged together and said marking pen is exposed for use when said component elements are separated from each other, and further comprising a pencil lead embedded in one of said component elements so as to protrude externally therefrom remote from said legs.

10. In a golf surface repair tool having a body and a pair of narrow elongated legs extending from said body and oriented in substantially mutually coplanar relationship and defining a gap therebetween, the improvement wherein said body is formed of component elements which are releaseably engageable to define an enclosure therewithin and which are also separable from each other, and further comprising a marking pen mounted on one of said component elements so as to fit into said enclosure when said component elements are releaseably engaged together and said marking pen is exposed for use when said component elements are separated from each other, and further comprising a cleat cleaner that is formed in said one of said component elements so as to protrude externally therefrom remote from said legs.

11. In a golf surface repair tool having a body and a pair of narrow elongated legs extending from said body and oriented in substantially mutually coplanar relationship and defining a gap therebetween, the improvement wherein said body is formed of component elements which are releaseably engageable to define an enclosure therewithin and which are also separable from each other, and further comprising a marking pen mounted on one of said component elements so as to fit into said enclosure when said component elements are releaseably engaged together and said marking pen is exposed for use when said component elements are separated from each other, and wherein a concave club handle rest is formed on said body remote from said legs.

12. In a golf surface repair tool having a body and a pair of narrow elongated legs extending from said body and oriented in substantially mutually coplanar relationship and defining a gap therebetween, the improvement wherein said body is formed of component elements which are releaseably engageable to define an enclosure therewithin and which are also separable from each other, and further comprising a marking pen mounted on one of said component elements so as to fit into said enclosure when said component elements are releaseably engaged together and said marking pen is exposed for use when said component elements are separated from each other, and wherein a thumb grip depression is formed in said body.

* * * * *